US005266744A

United States Patent [19]

Fitzmaurice

[11] Patent Number: 5,266,744

[45] Date of Patent: Nov. 30, 1993

[54] LOW INDUCTANCE TRANSMISSION CABLE FOR LOW FREQUENCIES

[76] Inventor: Dwight L. Fitzmaurice, 2506 Alvin St., Mountain View, Calif. 94043

[21] Appl. No.: 831,849

[22] Filed: Feb. 6, 1992

Related U.S. Application Data

[63] Continuation-in-part of Ser. No. 745,945, Aug. 16, 1991.

[51] Int. Cl.[5] ..... H01B 11/20

[52] U.S. Cl. ..... 174/103; 174/36; 174/74 R; 174/78; 174/113 C

[58] Field of Search ..... 174/103, 113 C, 36, 174/74 R, 74 A, 78, DIG. 8; 439/98, 99, 623

[56] References Cited

U.S. PATENT DOCUMENTS

| | | | |
|---|---|---|---|
| 1,667,598 | 4/1928 | Lenz | 439/623 |
| 2,243,851 | 6/1941 | Booth et al. | 174/103 |
| 2,403,816 | 7/1946 | Martin | 174/113 C |
| 2,453,313 | 11/1948 | Gordon | 174/103 |
| 2,623,093 | 12/1952 | Smith | 174/115 |
| 3,035,113 | 5/1962 | Danchuk | 174/74 A |
| 3,546,365 | 12/1970 | Collier | 174/78 |
| 3,867,006 | 2/1975 | Jeffress | 174/74 R |
| 3,897,127 | 7/1975 | Haitmanek | 178/78 X |
| 4,234,759 | 11/1980 | Harlow | 174/103 X |
| 4,431,861 | 2/1984 | Clabburn et al. | 174/73.1 |
| 4,588,852 | 5/1986 | Fetterolf et al. | 174/103 X |
| 4,599,483 | 7/1986 | Kuhn et al. | 174/103 X |
| 4,767,890 | 8/1988 | Magnan | 174/113 C X |
| 4,822,952 | 4/1989 | Katz et al. | 174/73.1 |
| 4,822,956 | 4/1989 | Sepe | 174/103 |
| 4,868,565 | 9/1989 | Mettes et al. | 174/36 |
| 4,965,410 | 10/1990 | Spector | 174/78 |
| 4,997,992 | 3/1991 | Low | 174/24 |
| 5,110,999 | 5/1992 | Barbera | 174/36 |

FOREIGN PATENT DOCUMENTS

| | | | |
|---|---|---|---|
| 138539 | 8/1950 | Australia | 174/113 C |
| 943611 | 3/1949 | France | 174/103 |

OTHER PUBLICATIONS

Shield-Kon TM Information; Thomas & Betts Co.; No. S-3; Jul. 1965.

*Primary Examiner*—Morris H. Nimmo

*Attorney, Agent, or Firm*—Flehr, Hohbach, Test, Albritton & Herbert

[57] ABSTRACT

In a transmission cable for low frequencies, first and second elongate transmission lines disposed in generally parallel alignment in close proximity to each other, each transmission line having an inner conductor and a coaxial outer conductor and insulating material disposed between the inner conductor and the coaxial outer conductor, and a jacket of insulating material covering said coaxial outer conductor, said outer coaxial conductor serving as a shield and means for grounding one end of each of the shields.

23 Claims, 2 Drawing Sheets

LOW INDUCTANCE TRANSMISSION CABLE FOR LOW FREQUENCIES

This application is a continuation-in-part of application Ser. No. 07/745,945, filed on Aug. 16, 1991.

This invention relates to a low inductance transmission cable for low frequencies, and more particularly to such a cable for use in an audio system for connecting the amplifier to an acoustic transducer such as a speaker.

Transmission cables for making connections between the amplifier and a loudspeaker have previously been available. However, it has been found that such cables have high reactance and that there is a substantial variation in the load presented by such cables. It has been found that this has caused a loss in the damping control normally provided by the amplifier. There is therefore a need for a new and improved transmission cable which overcomes the above-named disadvantages.

In general, it is an object of the present invention to provide a transmission cable for low and ultra low frequencies which has a low inductance.

Another object of the invention is to provide a transmission cable of the above character which has a high velocity of propagation.

Another object of the invention is to provide a transmission cable of the above character which has a controlled reactance.

Another object of the invention is to provide a transmission cable of the above character which utilizes parallel transmission lines with greatly reduced inductance.

Another object of the invention is to provide a transmission cable of the above character in which there is a great reduction in phase shift up to 20,000 Hz.

Another object of the invention is to provide a transmission cable of the above character which increases the damping factor.

Another object of the invention is to provide a transmission cable of the above character which has a reduced skin effect.

Another object of the invention is to provide a transmission cable of the above character which can be provided in various lengths.

Another object of the invention is to provide a transmission cable of the above character which can be readily and economically manufactured.

Additional objects and features of the transmission cable of the present invention will appear from the following description in which the preferred embodiments are set forth in conjunction with the accompanying drawings.

In general, the low inductance transmission cable for low frequencies of the present invention consists of first and second elongate coaxial transmission lines disposed in close proximity to each other. Each line consists of an inner conductor, an insulator disposed over the inner conductor and a coaxial metallic shield disposed on the insulator along substantially the entire length of the inner conductor. Means is provided for grounding each of the shields on one end of the cable. A flexible sheath is provided for the first and second elongate lines and extends substantially the entire length thereof.

Figure 1:
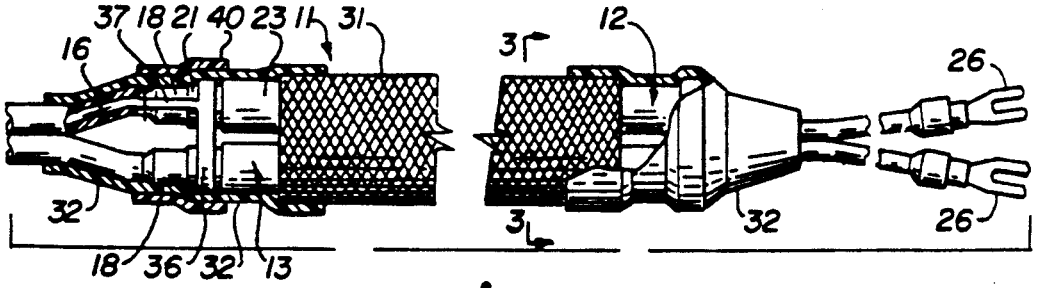
FIG. 1 is a plan view partially in cross section of a transmission cable incorporating the present invention.
Figure 2:
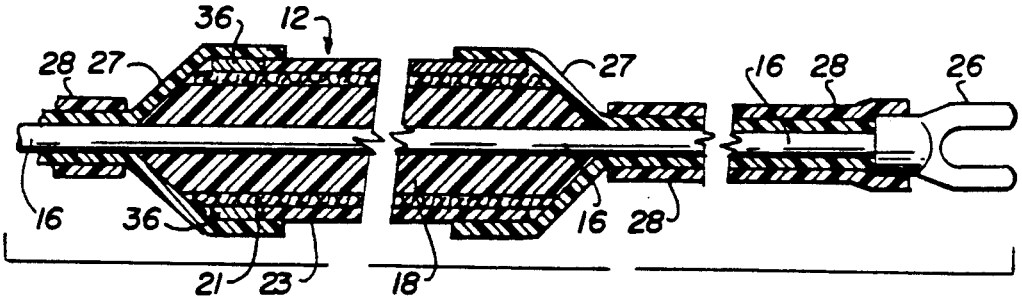
FIG. 2 is an enlarged cross sectional view of one of the coaxial transmission lines utilized in the transmission cable shown in FIG. 1.
Figure 3:
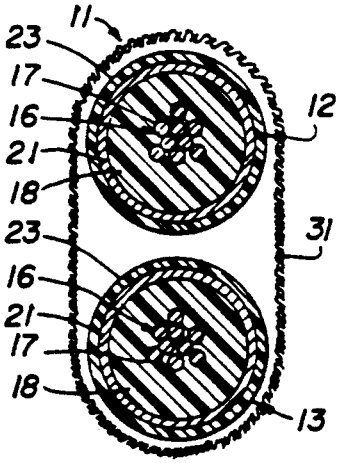
FIG. 3 is a cross sectional view taken along the line 3—3 of FIG. 1.

More particularly, as shown in FIGS. 1 through 3 of the drawings, the low inductance transmission cable 11 for low frequencies of the present invention consists of first and second elongate coaxial transmission lines 12 and 13 disposed in a generally parallel relationship in close proximity to each other. Each of the lines 12 and 13 consists of a central conductor 16 formed of a suitable good conducting material such as copper. In order to provide additional flexibility, the central conductor 16 is comprised of a plurality of copper strands 17. By way of example, to provide an 11 gauge central conductor 16, nine bare uninsulated copper strands 17 of 20 gauge wire are used. The central conductor 16 can be of any desired length ranging from 3 feet to 200–300 feet in length if desired. It, however, should be appreciated that for the longer lengths a smaller gauge, larger central conductor 16 should be provided. An 11 gauge central conductor 16 has been found to be adequate for home installations. For commercial applications utilizing large amplifiers, an 8 or a 6 gauge central conductor 16 should be utilized. In order to minimize the DC resistance to decrease power loss, the strands 17 are formed of a very high purity copper that is 9.97% pure or better and which is identified as an oxygen-free, linear crystal copper. It should be appreciated that, if desired, other high purity, good conducting metals such as silver can be utilized.

The central conductor 16 is encapsulated by or surrounded by a coaxial insulator 18 such as cellular or aerated polyethylene or Teflon (trademark). The radial thickness of the insulator 18 is selected to provide the desired impedance for a controlled inductive for the transmission line. The impedance desired can be calculated by utilizing the radial distance from the inside of the outer conductor to the outside of the inner conductor of the coaxial transmission line. Typically, these thicknesses are calculated to provide the desired impedance for a 30 ohm, 50 ohm, 75 ohm or 100 ohm load. For ultra low and low frequency use, the impedance is calculated for between 30 and 50 ohm loads. By way of an example, such a thickness is typically approximately 0.28 inches.

Each of the coaxial transmission lines 12 and 13 is provided with a coaxial shield 21 formed of a suitable conducting metal. By way of example, the shield 21 can be formed of a bare copper braid using 22 gauge copper strands to provide a coverage of at least 75% and preferably at least 95%. This braided shield 21 can be formed of other conducting metals, as for example silver-coated copper, silver or iron. It also should be appreciated that the shield 21 can be in the form of a solid sheath in the form of copper or aluminum foil, disposed coaxially of the insulator 18. The high percentage of coverage provided ensures that even high frequencies transmitted through the transmission lines would be prevented from escaping through the shield 21. Insulating jacket 23 extends coaxially over the shield 21 for substantially the entire length of the central conductor 16. The jacket 23 can be formed of any suitable insulating material, as for example black polyvinylchloride, having a suitable wall thickness, as for example 2 mils.

Terminations are provided for the lines 12 and 13, and as shown consist of spade lugs 26. The spade lugs 26 are of ultra high quality and are formed of copper which are heavily plated with rhodium or gold. The spade lugs 26 are bonded to the central conductor 16 by the use of high purity silver solder to provide a long lasting, low resistance connection. An insulating sleeve 27 formed of a suitable material such as shrink fit tubing supplied by Raychem of Menlo Park, Calif. extends over the bared extremities of the central conductor 16 and extends from the spade lug 26 to the coaxial insulator 18 and over the shield 21 and the jacket 23 so that no portions of the braided shield can break off and come into electrical contact with the central conductor 16. Additional shrink-fit tubing also of a suitable type such as provided by Raychem of Menlo Park, Calif., extends from over the spade lug 26 and over the sleeve 27 to near the insulator 18.

Another jacket or sheath 31 is provided over the transmission lines 12 and 13 to bundle the two lines 12 and 13 into a unitary assembly. The jacket or sheath 31 is relatively loose fitting and serves to prevent the lines 12 and 13 from separating and flopping around. The jacket or sheath 31 is formed of a loose braid of a suitable material such as Nylon (trademark), which has unctuous properties so as to facilitate slipping the lines 12 and 13 into the jacket or sheath. The jacket or sheath 31 should be relatively flexible. It also is desirable that it be formed of an insulating material, although this is not necessary. The jacket or sheath 31 facilitates use of the transmission cable when installing the same as hereinafter described. Two additional shrink-fit tubes 32 also of a suitable type as supplied by RayChem of Menlo Park, Calif., are provided on opposite ends of the jacket 31 to bind the two lines 12 and 13 together and also to secure them within the outer jacket or sheath 31.

In accordance with the present invention, one end of each of the shields are in electrical contact with each other and are terminated as hereinafter described. As shown in FIG. 1, the shields 21 are electrically connected together by suitable means such as a silver solder, or alternatively by a strap 36 formed of a conductive material also soldered to the shields 21 by suitable means such as a silver solder. When a negative post termination is desired, the strap 36 is connected to the central conductor 16 of the transmission line 12 or 13 depending upon which is designated as the negative line, which in the case of the transmission cable 11 shown in FIG. 1 is the line 12 carrying the central conductor 16 therein and which bears the negative sign. The lug 37 can be silver soldered to the strap 36 as well as to the central conductor 16.

Figure 4:
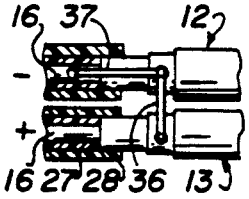
FIG. 4 is a schematic illustration of the ground termination provided in the cable in FIG. 1 used for a non-floating ground output.
Figure 5:
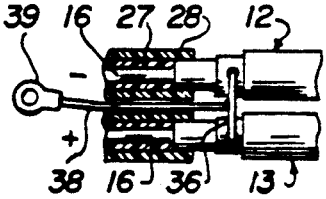
FIG. 5 is a schematic illustration similar to FIG. 4 showing a termination for a cable for a floating ground output.
Figure 7A:
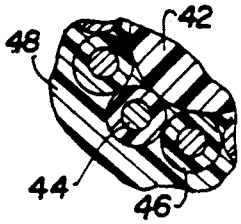
FIG. 7A is an enlarged fragmentary view of a portion of FIG. 7.

The electrical schematic for such a negative post termination is shown in FIG. 4 and is for use with amplifiers which have a non-floating ground. For amplifiers which utilize a floating ground, a small conducting wire 38 is connected to the strap 36 as shown in FIG. 5 by suitable means such as soldering, and is connected to an eyelet 39 or alternatively to an alligator clip (not shown) which can be connected to the chassis of the amplifier to provide the ground connection to the amplifier. As can be seen, either type of ground can be utilized with the transmission cable of the present invention to provide a very stable ground. In order to indicate which end of the transmission cable 11 is provided with the ends of the shields 21 which are grounded a band 40 of heat shrink tubing is disposed on that end of the transmission cable 11. Alternatively, printing or marking can be provided on that end of the transmission cable to indicate the grounded end.

A transmission cable 11 of the present invention constructed in the manner hereinbefore described has many desirable characteristics which make it particularly suitable for making connections between the amplifiers and acoustic transducers such as loudspeakers. The two transmission lines 12 and 13 utilized in the transmission cable 11 carry a high level output signal. Two central conductors are utilized with the ground shields. The ground shields carry no current and thus carry no floating voltages. The outer shields of the cable 11 are connected and grounded on one end only to a stable ground and therefore the current is only carried in the center conductors which prevents the creation of any substantial inductance in the positive coaxial transmission line 13 and also in the negative return transmission line 12. The terminations are insulated from each other to prevent the center conductors from making contact with each other or with the shields. The transmission cable of the present invention greatly reduces the self-inductance created within the transmission lines and controls the inductance of the transmission cable 11.

A transmission cable manufactured in accordance with the present invention has an inductance of approximately 0.225 micro Henrys per foot, a measured capacitance of approximately 16.7 picofarads per foot and a measured DC resistance of approximately 0.997 ohm per 1000 feet, or approximately 0.002 ohm per foot for both the positive and return lines combined, to achieve a speed of propagation which is at least 78% of the speed of light. It should be appreciated that the parameters recited above can vary within plus or minus 10% and still be within the scope of the present invention.

Additional measured electrical parameters have been found to be important with respect to the transmission cable of the present invention such as an electrical response of −3 db at 100 megahertz. A 0.05% maximum phase shift in the audio range was measured. This small amount of phase shift makes it possible to provide longer cables without creating any significant phase shift. A resistance of less than 0.002 ohm per foot for both positive and return lines combined. An approximately 65% increase in wide band damping was achieved when the transmission cable of the present invention was utilized in most audio systems when used in place of some other prior art cables. Substantially no parallel line inductance was measured. A speed of propagation of 75% of the speed of light was obtained for the entire transmission cable assembly.

Figure 6:
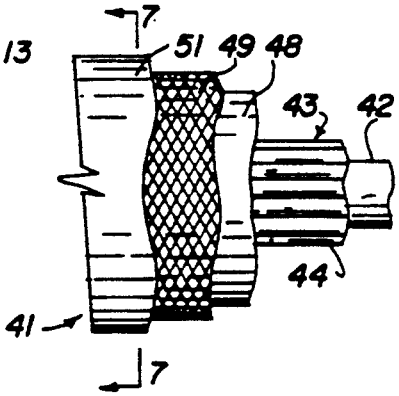
FIG. 6 is a side elevational view partially in cross section of another embodiment of a transmission cable incorporating the present invention.
Figure 7:
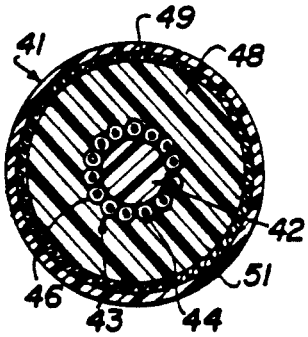
FIG. 7 is a cross sectional view taken along the line 7—7 of FIG. 6.

Another embodiment of a transmission cable incorporating the present invention is shown in FIGS. 6 and 7. As shown therein, the transmission cable (not shown) is comprised of coaxial transmission lines 41 which are particularly suitable for ultra low and low frequency use. The transmission line 41 consists of a central cylindrical core insulator 42 formed of a suitable material such as cellular polyethylene. A central conductor 43 is coaxially disposed on the central insulator 42.

Rather than being a large grouping of wires overlying each to form a central conductor 16 as in the embodiment shown in FIGS. 1 through 3, there are provided a plurality of copper wires 44, as for example of a 20 gauge size, which are disposed side by side in a parallel fashion in a circle extending over the circumference of the insulator 42 as shown in FIGS. 6 and 7. Each of the wires 44 is provided with its own insulation cover 46, as for example a very thin layer, as for exam 0.001 inches, of a high temperature insulating material as Kapton (trademark). As can be seen, the wires 44 are disposed concentrically about the central insulator 42 and are evenly spaced about the circumference of the central core insulator 42. The wires 44 are surrounded or encircled by another insulator 48 also formed of a suitable insulating material such as cellular polyethylene or Teflon. A coaxial copper shield 49 is provided on the insulator 48 and is formed of the same material as the shield 21. A jacket 51 formed of a suitable insulating material such as black polyvinylchloride covers the shield 49.

Two of the transmission lines 41 can be utilized to provide a transmission cable of the type hereinbefore described in conjunction with FIG. 1. They also can be enclosed in a jacket or sheath such as a jacket 31 provided in the transmission cable 11. Terminations of the type shown for the transmission cable 11 can also be provided.

A transmission cable utilizing two parallel transmission lines 41 has numerous advantages. By laying straight conductors on a center dielectric formed by the central insulator 42, there is created a circle of conductors in a shielded transmission line. This causes magnetic fields that build up around a wire carrying an AC current to react only with the two side wires and not a large group of wires as in a bundled or wrapped design, to thereby reduce the inductive constant of the wire. This allows the conductor to approach the ideal tubular conductor without the increased current density on the surface of the conductor which is inherent in a tubular conductor design. The coating of each of the wires 44 with the insulation 46 serves to prevent electron transfer from wire to wire, particularly at high frequencies which tend to cause the electrons to travel in the outer skin of the wire. This serves to further reduce the reactance and the phase shift over that achieved with the transmission cable 11 shown in FIG. 1. The transmission line 41 also permits a larger wire diameter to be utilized for the wires 44 before the skin effect becomes noticeable because of the speed of propagation of current in the wire. The speed of propagation is 86% of the speed of light or better. The phase shift below 200,000 Hertz is less than 0.02 degrees for 25 feet. The inductance is less than 0.225 micro Henrys per foot. The capacitance was also better than 16.6 picofarads per foot because of the very high dielectric constant of 2.0 for the Teflon material utilized as the insulator.

Figure 8:
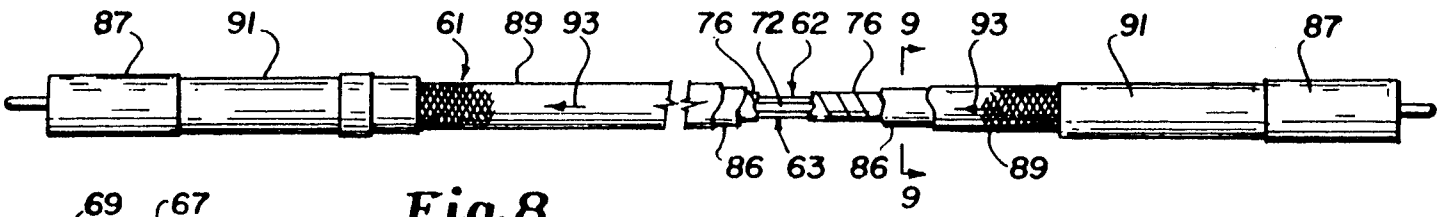
FIG. 8 is a side elevational view of an audio interconnect cable incorporating the present invention which is provided with RCA connectors.
Figure 9:
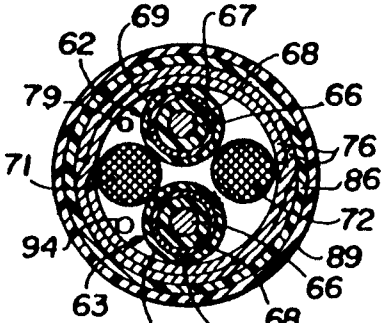
FIG. 9 is a cross-sectional view taken along the line 9-9 of FIG. 8 and also taken along the line 9-9 of FIG. 11.

Another embodiment of the transmission cable incorporating the present invention is shown in FIGS. 8 and 9 in which the transmission cable is in the form of an audio interconnect cable 61 which is provided with RCA connectors. It consists of first and second transmission lines 62 and 63 with line 62 being for the transmission of positive frequencies and line 63 being for the transmission of negative frequencies. The transmission lines 62 and 63 are comprised of an inner conductor 66 and a coaxial outer conductor 67. The inner conductors 66 are formed of a very high purity material as, for example, 20 gauge copper having a diameter of 0.031" of high purity as, for example, 99.997% pure linear crystal, oxygen-free copper. The inner conductors 66 are covered by a dielectric layer 68 formed of a suitable material such as polypropylene of a suitable size as, for example, one having a 0.1" outside diameter to provide a transmission line having a suitable impedance such as 90 ohms.

The coaxial outer conductors 67 encase or are disposed over the dielectric layer 68. These outer coaxial conductors 67 are formed of a suitable material such as a woven copper braid provided with an exterior tinplate to provide approximately 90% coverage of the dielectric. This braid 67 provides shielding against inductive interactions and thereby reduces the inductance to a very low value. This high quality shielding also serves to control the overall reactive capacitance within the cable 61.

The coaxial outer conductors 67 on the two transmission lines 62 and 63 are insulated from each other in a similar manner as, for example, by providing a jacket 69 of a suitable insulating material such as polyethylene. Typically, the polyethylene can have a thickness ranging from 0.035" to 0.045". These jackets 69 of insulating material serve to insulate the transmission lines 62 and 63 from each other and also from shorting out with any other conductor that is in the cable 61.

Means is provided for retaining the transmission lines 62 and 63 within predetermined locations within the cable and consists of first and second elongate bundles 71 and 72 which extend along the length of the transmission lines 62 and 63. The bundles 71 and 72 are formed of a highly resilient fluffy material of a suitable type as, for example, a pulled Nylon-type braid which are circular in cross-section as shown in FIG. 9. The bundles 71 and 72 of the stuffing material serve to provide a cable which has a generally circular appearance to provide a more aesthetically pleasing cable. The bundles 71 and 72 along with the transmission lines 62 and 63 are covered with an aluminum foil wrap 76. The wrap 76 is formed by a strip 77 which is an aluminized Mylar foil. By way of example, the foil can have a thickness of 0.003" with 0.0025" aluminum and 0.0005" Mylar. The strip 77 is helically wound around the transmission lines 62 and 63 and the bundles 71 and 72 with a suitable overlap ranging from 20% to 75% and, preferably, approximately 50%. This wrap 76 is provided to minimize, if not eliminate, radio frequency interference in the transmission lines 61 and 62. The inner surface of these strips 77 is aluminized and is connected to a drain wire 79 by a suitable means such as solder 81. The drain wire 79 is formed of a suitable material such as a 20 gauge high purity copper of the type hereinbefore described.

The entire assembly thus far described is encapsulated within a jacket 86 of a suitable insulating material as, for example, polyvinylchloride which has a thickness ranging from 0.050" to 0.075" so that the overall diameter is approximately 0.350" or slightly less so that it will readily fit within the RCA connectors 87 provided at opposite ends of the cable 61. A woven covering 89 is applied over the jacket 86 and is formed of a suitable material such as black woven Nylon to provide an anti-abrasion covering for the cable. This woven covering 89 gives a more aesthetically pleasing exterior appearance to the transmission cable 61. The woven covering 89 also facilitates installation of the cable so that it can be readily placed behind cabinets or cupboards without being caught. The covering 89 makes it possible to slip the cable into and out of tight places. The RCA connectors 87 are of the conventional type. However, they are specially rhodium plated to provide ultra-low conductivity connections. Shrink tubing 91 is provided for providing re-enforcement between the RCA connectors 87 and the interconnect cable 61 and extends over the woven covering 89 as shown, particularly, in FIG. 8. When the shrink tubing 91 is put in place, a hot glue can be utilized with the same to keep the connectors from pulling off of the cable and vice versa.

Arrows 93 are provided on the woven covering 89 and indicate the source to destination direction for the transmission lines 62 and 63 as shown particularly in FIG. 8. Single-ended grounding is provided for the shields for the independent transmission lines 62 and 63. It has been found that this is important because when the RF shields are connected to the destination end a more stable ground is provided. As shown schematically in FIG. 10, the inner conductor 66 of the transmission line 62 is utilized as the signal carrying conductor. The other inner conductor 66 of the transmission line 63 serves as the ground connection wire or conductor, is grounded on the destination end and is pointed to by arrows 93. The wrap 76 is connected by a drain wire 79 to ground through the inner conductor 66 of the transmission line 63 and by a drain line 94 connected to the coaxial outer conductor 67 of the transmission lines 61 and 62 by solder 96 to the inner connector 66 of the transmission line 63 to ground.

Figure 11:
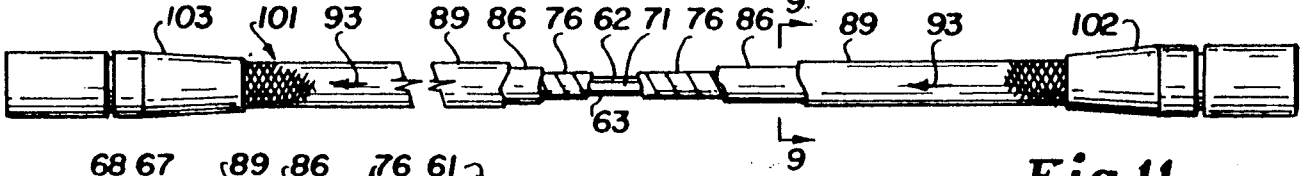
FIG. 11 is a side elevational view of another audio cable incorporating the present invention with XLR connectors.
Figure 12:
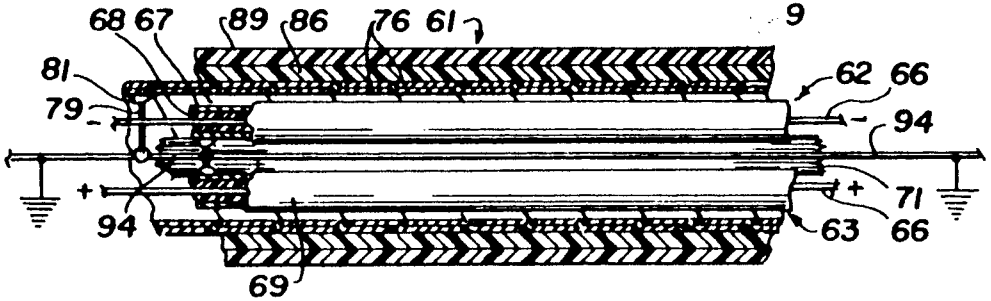
FIG. 12 is a schematic illustration of the audio cable as shown in FIG. 11.

Another embodiment of the audio interconnect cable 101 is shown in FIG. 11. It is substantially identical to that shown in FIG. 8 with the exception that in place of the RCA connectors 87, there are provided an XLR male connector 102 at one end and an XLR female connector 103 on the other end. The RCA type of audio interconnect cable provided in FIG. 8 utilizes two connectors with two transmission lines and single-ended grounding whereas the XLR interconnect cable 103 provides balanced double-ended grounding with three transmission lines. To obtain the three transmission lines, the transmission line 62 is utilized as an inverting transmission line whereas the transmission line 63 is utilized as a non-inverting transmission line. Thus, each transmission line only carries one-half of the signal and for that reason presents only one-half of the overall resistance in any given length of transmission line. To provide the third transmission line or conductor, the drain lines 79 and 94 are connected to ground as shown in FIG. 12. Thus, the outer conductors 67 of the transmission lines 62 and 63 are connected to ground as shown. As in the previous interconnect cable 61, the drain wires 79 and 94 connected to the wraps 76 are connected to ground.

It has been found that the construction shown in FIG. 11 particularly lends itself to use in audio interconnect cables for professional audio systems as, for example, used in rock concerts. Such cable or cables have lower distortion and higher speeds of transmission and permit longer cable runs.

From the foregoing, it can be seen that audio interconnect cables incorporating the present invention make it possible to provide two independent transmission lines that are impedance controlled and which can be utilized for carrying the signal. Impedance of approximately 100 ohms can be readily achieved. The impedance is controlled by preventing inductive interaction. Very high dielectric constants are achieved by the use of aerated Teflon for the dielectric.

In an audio interconnect cable of the present invention, such a cable typically will not see a voltage of 15 volts and less than approximately 0.5 amperes current. Reducing this voltage build-up reduces the tendency to bleed down after the signal has died down to thereby reduce distortion.

Solid conductors have been utilized for a relatively small gauge as, for example, 20 gauge have been utilized to minimize the skin effect.

In accordance with the present invention, each individual signal carrying wire is individually shielded and also is individually its own impedance controlled transmission line thereby preventing or greatly reducing inductive interaction of the conductors within the transmission line itself. By appropriate impedance control the speed of propagation along the transmission line is increased. In the present invention, it has been possible to increase the size of the center conductor of the transmission line without encountering serious skin effect problems. This is achieved by providing an increased speed of propagation which is accomplished by utilizing a center conductor of a greater size to provide greater current carrying capabilities and lower Dc resistance.

Figure 10:
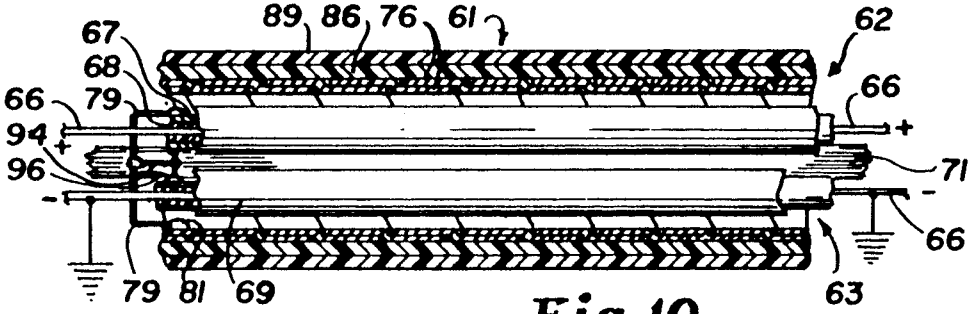
FIG. 10 is a schematic illustration of the cable shown in FIGS. 8 and 9.

In connection with the schematic illustration shown in FIG. 10, it should be appreciated that the grounding is the same type as that shown in FIG. 4 with the exception that an additional shield is provided which is also connected to ground. The XLR balanced wires shown in FIGS. 11 and 12 have the same electrical connection as that shown in FIG. G. 5 with the exception that in FIGS. 11 and 12 a third shield is provided which is also grounded. As explained previously, this third shield in the interconnect cables is important because the low level signals which are being transmitted have an opportunity to pick up radio frequency noise when they are supplied to an amplifier.

This is contrary to the situation wherein the transmission cable is utilized for connection to a speaker which does not amplify the signals. For this reason, the signal-to-noise ratio in the interconnect cable is much more important when the cables are not connected to speakers.

Typically, the audio interconnect cables of the present invention can be utilized for connecting one device to another as, for example, turntables, tape decks, CD players, reel-to-reel decks and like to preamplifiers. These all provide low level outputs which are supplied to the preamplifier.

A transmission cable made in accordance with the present invention provides increased frequency extension (flat response without phase shift) in both the low and high frequencies. It also makes possible a tighter, more defined bass control. Better stereo imaging is achieved because of the reduced phase distortion. Increased dynamics are achieved by decreasing the current density in the conductor which is achieved by reducing the skin effect and increasing the back EMF (amping) control of the amplifier.

From the foregoing it can be seen that a greatly improved transmission cable has been provided which is particularly suitable for ultra low frequencies and low frequencies. In both embodiments of the invention, the center conductor is utilized in an impedance controlled transmission line design. The transmission cable can be utilized in grounded and floating ground applications. It should be appreciated that an additional cable of the present invention can be used to provide a bi-wire speaker installation to separate cross over sections in the speakers for high and low frequencies. Similarly, three of the transmission cables of the present invention can be used in a tri-wire speaker installation to separate low, medium and high frequency cross over sections.

What is claimed is:

1. In a reactance controlled transmission cable for low frequencies, first and second elongate transmission lines disposed in generally parallel alignment in close proximity to each other, each transmission line having an inner conductor and a coaxial outer conductor and a coaxial insulator formed of insulating material disposed between the inner conductor and the coaxial outer conductor and having a radial thickness selected to provide a controlled inductive field and a jacket of insulating material covering said coaxial outer conductor, said outer coaxial conductor serving as a shield and means for grounding only one end of each of the shields of the first and second elongate transmission lines.

2. A transmission cable as in claim 1 wherein said first transmission line serves as a positive line, wherein said second transmission line serves as a negative or return line and wherein said means for grounding one end of each of said shields includes means for connecting said shields to the center conductor of the negative or return transmission line.

3. A transmission cable as in claim 1 wherein said means for grounding one end of each of the shields includes a separate conductor connected to the shields and means for connecting said separate conductor to ground to provide a non-floating ground.

4. A transmission cable as in claim 1 together with a flexible sheath surrounding the first and second elongate transmission lines and serving to bind the transmission lines into a unitary assembly.

5. A transmission cable as in claim 1 together with termination means secured to each end of the inner conductor of each transmission line.

6. A transmission cable as in claim 1 wherein said shield of each transmission line is comprised of a material providing at least 95% coverage of the insulator disposed between the inner and outer conductors.

7. A transmission cable as in claim 1 wherein said inner conductor is formed of a plurality of wires extending side by side and being disposed in a circle.

8. A transmission cable as in claim 7 wherein each of said wires is provided with an insulating coating.

9. A transmission cable as in claim 7 together with an insulating member disposed within the circle of conductors.

10. A transmission cable as in claim 1 which has a speed of propagation of current in the cable of at least 75% of the speed of light.

11. A transmission cable as in claim 1 having a phase shift of less than 0.05%.

12. A transmission cable as in claim 9 wherein each transmission line has a speed of propagation of 86% or better of the speed of light.

13. A transmission cable as in claim 1 wherein the cable has a DC resistance of 0.997 ohm per 1000 feet or less.

14. A transmission cable as in claim 1 having a capacitance of 16.7 picofarads per foot or less.

15. A transmission cable as in claim 9 having an inductance of less than approximately 0.225 micro Henrys per foot or less.

16. In a transmission cable for low frequencies, first and second elongate transmission lines disposed in generally parallel alignment in close proximity to each other, each transmission line having an inner conductor and a coaxial outer conductor and insulating material disposed between the inner conductor and the coaxial outer conductor and a jacket of insulating material covering said coaxial outer conductor, said outer coaxial conductor serving as a shield and means for grounding one end of each of the shields, the inner conductor being formed of a plurality of strands of copper having a purity of 99.97% or better.

17. A transmission cable as in claim 1 together with stuffing material disposed on opposite sides of the first and second elongate transmission lines and a jacket covering the first and second elongate transmission lines and said stuffing material, said jacket being substantially circular in cross-section.

18. A transmission cable as in claim 17 together with a metallized foil underlying said jacket and wrapped around said first and second elongate transmission lines.

19. A transmission line as in claim 18 together with a drain line connected to said foil and connected to ground.

20. A transmission line as in claim 17 together with a woven covering on said jacket.

21. In a transmission line, a centrally disposed insulating core member, a plurality of conductor wires arranged side by side and arranged in a circle around the insulating member and an additional insulating coaxial member overlying the circle of conductor wires, an outer coaxial conductive sheath disposed on the additional insulating coaxial member and a jacket of insulating material disposed over the outer coaxial conductive sheath.

22. A transmission line as in claim 21 wherein said conductor wires are each provided with an insulating coating.

23. In a transmission line, a centrally disposed insulating core member, a plurality of conductor wires arranged side by side and arranged in a circle around the insulating member and an additional insulating core member overlying the wire conductors, an outer coaxial conductive sheath disposed on the additional insulator and a jacket of insulating material disposed over the conductive sheath, said wire conductors being formed of a high purity copper having a purity of 99.97% or better.

* * * * *